US009907423B1

(12) United States Patent
Thurmond, Jr. et al.

(10) Patent No.: US 9,907,423 B1
(45) Date of Patent: Mar. 6, 2018

(54) BALLROOM DANCE SHOE AID

(71) Applicants: Robert C. Thurmond, Jr., Tampa, FL (US); Valerie A. Slattery, Clearwater, FL (US)

(72) Inventors: Robert C. Thurmond, Jr., Tampa, FL (US); Valerie A. Slattery, Clearwater, FL (US)

( * ) Notice: Subject to any disclaimer, the term of this patent is extended or adjusted under 35 U.S.C. 154(b) by 0 days.

(21) Appl. No.: 15/191,224

(22) Filed: Jun. 23, 2016

(51) Int. Cl.

| | |
|---|---|
| ***B25B 23/18*** | (2006.01) |
| ***A47G 25/90*** | (2006.01) |
| ***A43C 11/14*** | (2006.01) |
| ***A43B 5/12*** | (2006.01) |
| ***A44B 13/00*** | (2006.01) |
| ***F21V 23/04*** | (2006.01) |
| ***F21L 4/00*** | (2006.01) |
| ***F21V 5/04*** | (2006.01) |
| ***F21V 33/00*** | (2006.01) |
| *F21Y 115/10* | (2016.01) |

(52) U.S. Cl.
CPC ..... *A47G 25/90* (2013.01); *A43B 5/12* (2013.01); *A43C 11/14* (2013.01); *A44B 13/00* (2013.01); *F21L 4/005* (2013.01); *F21V 5/04* (2013.01); *F21V 23/04* (2013.01); *F21V 33/0084* (2013.01); *F21Y 2115/10* (2016.08)

(58) Field of Classification Search
CPC ..... A47G 25/90; A43B 5/12; A43C 11/14; A44B 13/00; F21L 4/005; F21V 5/04; F21V 23/04; F21V 33/0084
USPC ..... 362/119
See application file for complete search history.

(56) References Cited

U.S. PATENT DOCUMENTS

| | | | | | |
|---|---|---|---|---|---|
| 68,361 | A * | 9/1867 | Goldthwait | A47G 25/92 | 24/40 |
| 349,415 | A * | 9/1886 | Taylor | A47G 25/92 | 24/40 |
| 368,024 | A * | 8/1887 | Smith | A47G 25/92 | 24/40 |
| 4,247,140 | A * | 1/1981 | Gordon | B65G 7/12 | 24/546 |
| 5,515,249 | A * | 5/1996 | Shiao | B25B 13/56 | 362/119 |
| 5,652,587 | A * | 7/1997 | Liu | G07C 9/00944 | 341/176 |
| 5,845,986 | A * | 12/1998 | Breen | B25B 23/18 | 362/119 |
| 6,022,120 | A * | 2/2000 | Chang | F21V 33/00 | 361/232 |
| 6,027,224 | A * | 2/2000 | Schnell | B26B 11/00 | 362/119 |
| 6,086,217 | A * | 7/2000 | Jau | B25B 23/18 | 362/109 |

(Continued)

*Primary Examiner* — Bryon T Gyllstrom

(57) ABSTRACT

A tool has a lower component formed as a tool hook and an upper component formed as a handle. The handle has a configuration with a top, a bottom, a front, a back and sides. The handle has a chamber with a panel to provide access to the chamber. The tool hook extends downwardly from the bottom of the handle. The tool hook is fabricated of a rigid wire with parallel side portions and a semi-circular portion coupling the side portions. The side portions are spaced by a width. The semi-circular portion is spaced from the bottom by a length. The width is less than the length. An electrical assembly constitutes a portion of the handle. The electrical assembly includes a source of illumination, a source of potential, and a switch.

2 Claims, 3 Drawing Sheets

(56) References Cited

U.S. PATENT DOCUMENTS

| | | | | |
|---|---|---|---|---|
| 6,086,223 | A * | 7/2000 | Fogle | E05B 17/10<br>362/23.01 |
| 2002/0154499 | A1 * | 10/2002 | Hsieh | B25B 23/18<br>362/120 |

* cited by examiner

FIG. 3
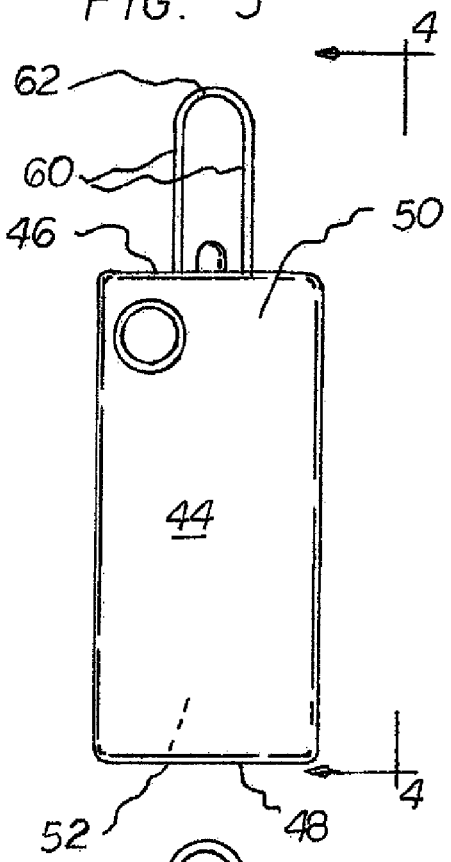
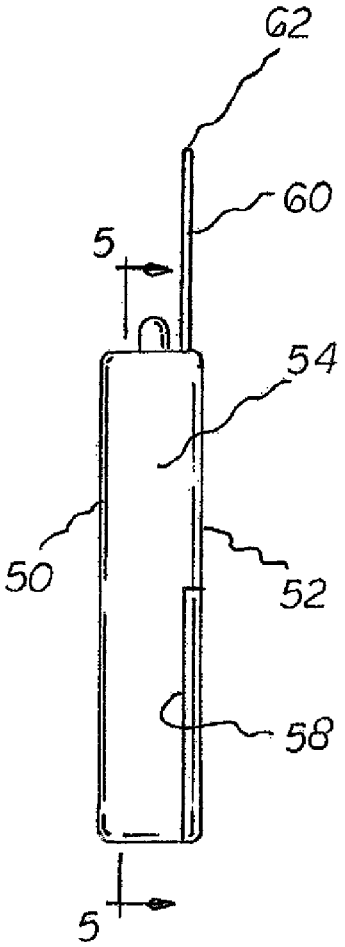
FIG. 4
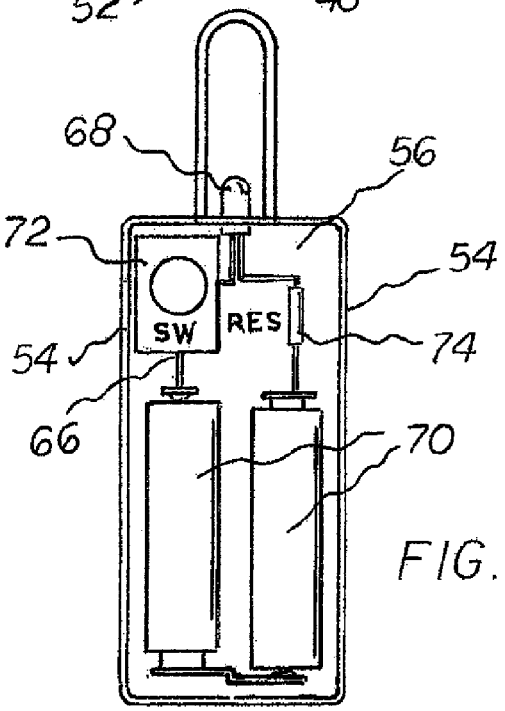
FIG. 5

BALLROOM DANCE SHOE AID

BACKGROUND OF THE INVENTION

Field of the Invention

The present invention relates to a ballroom dance shoe aid and more particularly pertains to buckling and unbuckling a ballroom dance shoe in a safe, quick, convenient, and economical manner.

Description of the Prior Art

The use of buckles in the field of apparel is known in the prior art. The use of buckles in shoes, including lady's ballroom dance shoes, is also known in the prior art. Nowhere in the prior art, however, is there a tool for buckling and unbuckling a lady's ballroom dance shoes.

While known buckle tools fulfill their respective, particular objectives and requirements, they do not describe a ballroom dance shoe aid that allows buckling and unbuckling a ballroom dance shoe in a safe, quick, convenient, and economical manner.

In this respect, the ballroom dance shoe aid according to the present invention substantially departs from the conventional concepts and designs of the prior art, and in doing so provides an apparatus primarily developed for the purpose of buckling and unbuckling a ballroom dance shoe in a safe, quick, convenient, and economical manner.

Therefore, it can be appreciated that there exists a continuing need for a new and improved ballroom dance shoe aid which can be used for buckling and unbuckling a ballroom dance shoe in a safe, quick, convenient, and economical manner. In this regard, the present invention substantially fulfills this need.

SUMMARY OF THE INVENTION

In view of the disadvantages inherent in the known types of tools for buckling and unbuckling ballroom dance shoes of known designs and configurations now present in the prior art, the present invention provides an improved ballroom dance shoe aid. As such, the general purpose of the present invention, which will be described subsequently in greater detail, is to provide a new and improved ballroom dance shoe aid and method which has all the advantages of the prior art and none of the disadvantages.

To attain this, for a broad perspective, the present invention essentially comprises a tool having a lower component formed as a tool hook and an upper component formed as a handle. The handle has a configuration with a top, a bottom, a front, a back and sides. The handle has a chamber with a panel to provide access to the chamber. The tool hook extends downwardly from the bottom of the handle. The tool hook is fabricated of a rigid wire with parallel side portions and a semi-circular portion coupling the side portions. The side portions are spaced by a width. The semi-circular portion is spaced from the bottom by a length. The width is less than half the length. An electrical assembly constitutes a portion of the handle. The electrical assembly includes a source of illumination, a source of potential, and a switch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and aids for carrying out the several purposes of the present invention. It is important, therefore, that the claims be regarded as including such equivalent constructions insofar as they do not depart from the spirit and scope of the present invention.

It is therefore an object of the present invention to provide a ballroom dance shoe aid for buckling and unbuckling a ballroom dance shoe in a safe, quick, convenient, and economical manner.

It is a further object of the invention to provide a new and improved ballroom dance shoe aid which has all of the advantages of the prior art tools for buckling and unbuckling ballroom dance shoes of known designs and configurations and none of the disadvantages.

It is another object of the present invention to provide a new and improved ballroom dance shoe aid which may be easily and efficiently manufactured and marketed.

It is a further object of the present invention to provide a new and improved ballroom dance shoe aid which is of durable and reliable constructions.

An even further object of the present invention is to provide a new and improved ballroom dance shoe aid which is susceptible of a low cost of manufacture with regard to both materials and labor, and which accordingly is then susceptible of low prices of sale to the consuming public, thereby making such ballroom dance shoe aid economically available to the buying public.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the tool shown in FIGS. 1 and 2.

FIG. 4 is a side elevational view of the tool taken along line 4-4 of FIG. 3.

FIG. 5 is a front elevational view of the tool taken along line 5-5 of FIG. 4, similar to FIG. 3, but with the back removed.

The same reference numerals refer to the same parts throughout the various Figures.

DESCRIPTION OF THE PREFERRED EMBODIMENT

Figure 1:
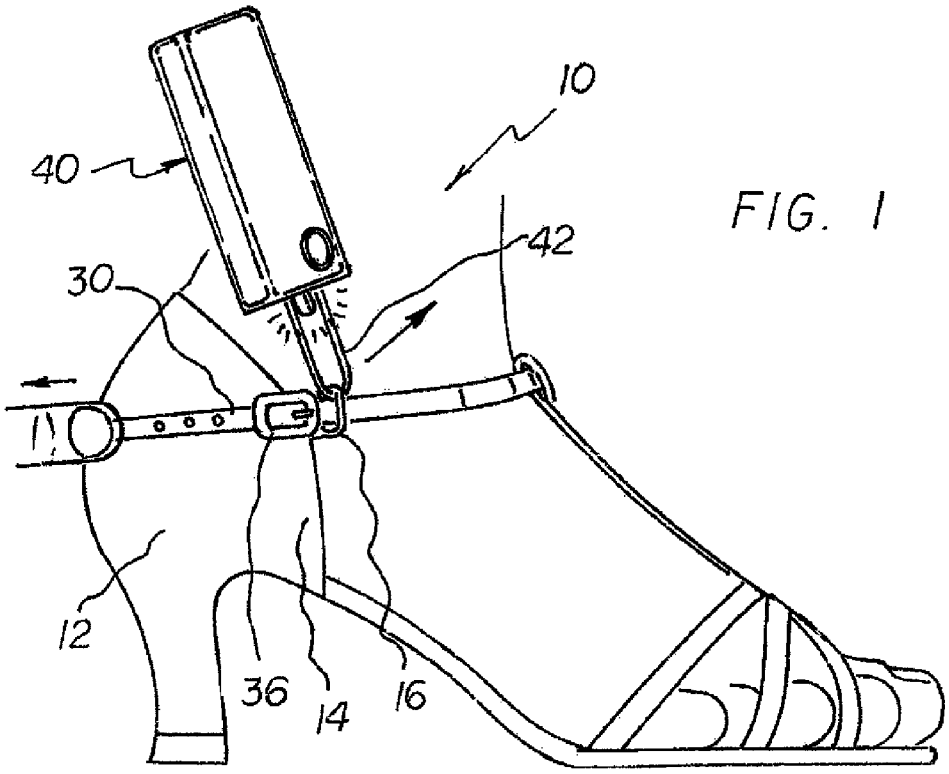
FIG. 1 is a side elevational view of a ballroom dance shoe aid constructed in accordance with the principles of the present invention, the aid being in a partially engaged orientation.

With reference now to the drawings, and in particular to FIG. 1 thereof, the preferred embodiment of the new and improved ballroom dance shoe aid embodying the principles and concepts of the present invention and generally designated by the reference numeral 10 will be described.

The present invention, the ballroom dance shoe aid 10 is comprised of a plurality of components. Such components in their broadest context include a tool and an electrical assembly. Such components are individually configured and correlated with respect to each other so as to attain the desired objective.

From a specific perspective, the invention of the present application is a ballroom dance shoe aid 10 for buckling and unbuckling a ballroom dance shoe 12 in a safe, quick, convenient, and economical manner. First provided is the ballroom dance shoe 12. The ballroom dance shoe has a side section 14 with a forwardly extending buckle hook 16. The buckle hook has a rearward region 18 pivotably coupled to the side section. The buckle hook has a forward region 20 in a generally U-shaped configuration. The forward section has a central opening 22 with an outer hook 24 extending rearwardly to provide a passageway 26 to and from the central opening.

Figure 2:
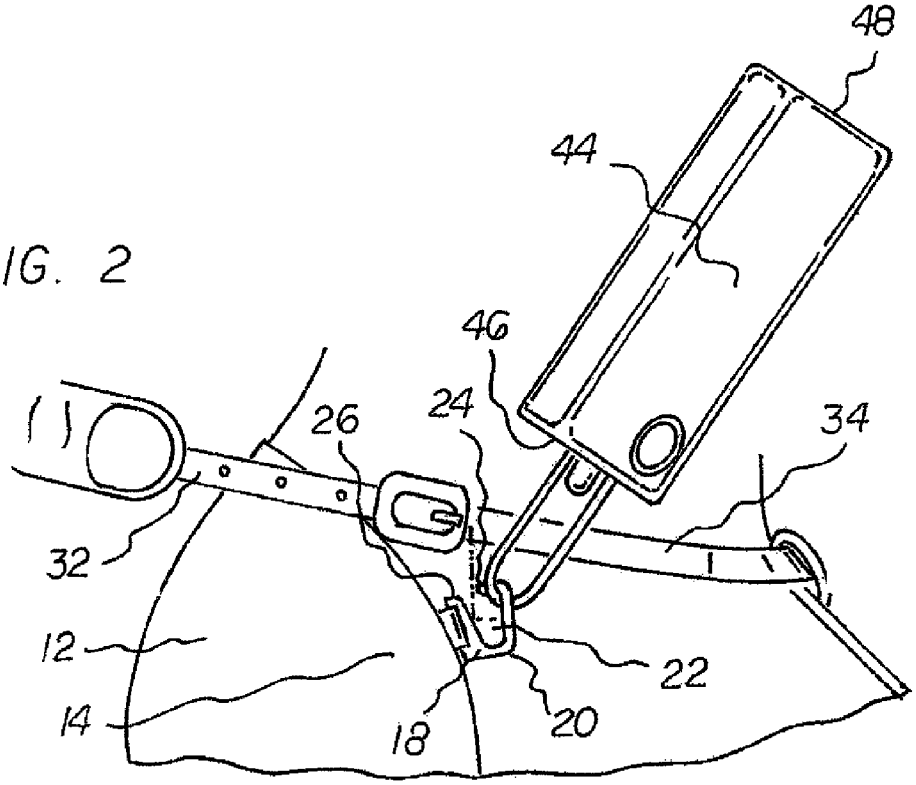
FIG. 2 is an enlarged side elevational view of the FIG. 1 aid, the aid being in a disengaged orientation.

Note is taken that FIGS. 3-7 illustrate the aid with the top, tool hook, and light facing upwardly. FIGS. 1 and 2 illustrate the aid in an inverted orientation with the top, tool hook, and light facing downwardly.

Next provided is a strap 30. The strap has a rearward exterior section 32 and a forward interior section 34. A strap buckle 36 is provided. The forward interior section is attached to the shoe. The strap buckle is fixedly secured to the strap between the rearward exterior section and the forward interior section. The strap forwardly of the strap buckle is movable through the passageway when buckling and unbuckling the ballroom dance shoe.

Next provided is a tool 40. The tool includes a lower component formed as a tool hook 42 and an upper component formed as a handle 44. The handle has a rectilinear configuration with a top 46, a bottom 48, a front 50, a back 52, and left and right sides 54. A chamber 56 is formed within the handle with a removable panel 58 in the back to provide access to the chamber. The tool hook extends downwardly from the bottom of the handle. The tool hook is fabricated of a rigid wire with parallel side portions 60 and a semi-circular portion 62 coupling the side portions. The side portions are spaced by a width. The semi-circular portion is spaced from the bottom by a length. The width is from approximately 18 percent to 25 percent of the length.

In the preferred embodiment, the tool hook has a semi-circular central portion with two parallel or essentially parallel linear portions. Both linear portions extend from the central portion to the handle. In an alternate embodiment of the invention, one of the linear portions may be eliminated.

Lastly, an electrical assembly 66 is provided. The electrical assembly constitutes a portion of the handle. The electrical assembly includes a source of illumination 68, a source of potential 70, a switch 72, and a resistor 74. The source of illumination is a light emitting diode extending downwardly from the bottom of the handle. The switch extends through the front adjacent to the bottom of the handle. The source of potential includes two batteries laterally spaced within the handle.

Figure 6:
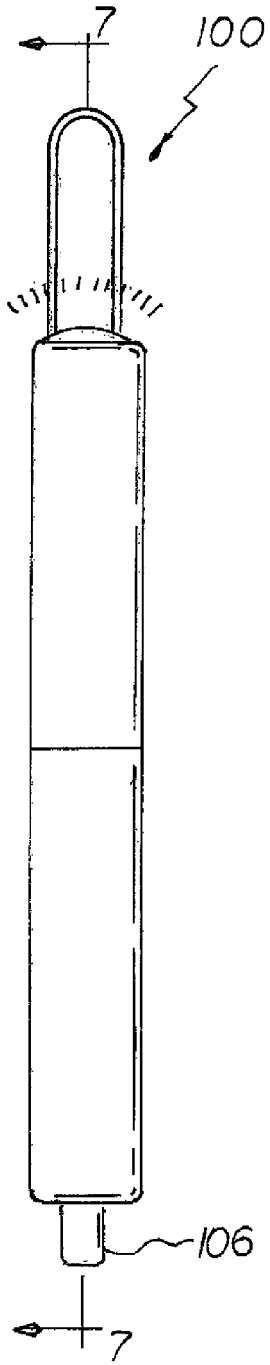
FIG. 6 is a front elevational view of a tool similar to that shown in FIG. 3 but illustrating an alternate embodiment of the invention.
Figure 7:
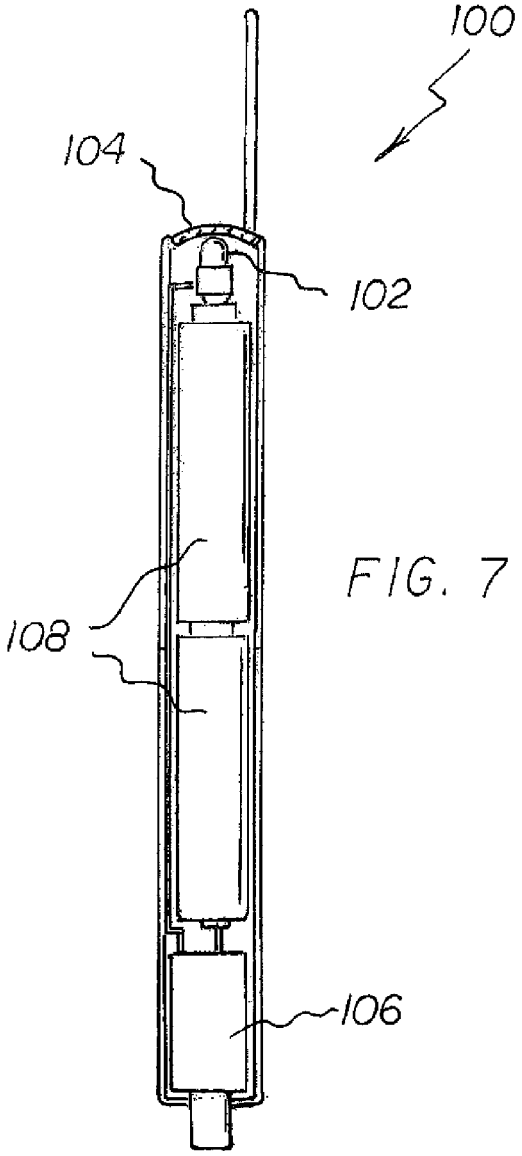
FIG. 7 is a side elevational view of the tool taken along line 7-7 of FIG. 6.

An alternate embodiment of the tool 100 is illustrated in FIGS. 6 and 7. In this embodiment, the source of illumination is an incandescent bulb 102 and lens 104 facing downwardly from the bottom of the handle. In this embodiment, the switch 106 extends through the top of the handle and the two batteries included in the source of potential 108 are axially spaced within the handle.

Many ladies' ballroom dance shoes incorporate a slip-in foot strap and buckle arrangement. Note FIGS. 1 and 2. This has the advantage of providing a very secure shoe attachment, but it requires that the strap be buckled tightly to provide firm tension against the foot. Due to the relatively high strap tension, it can be difficult to buckle and unbuckle. The problem is exacerbated by such typical factors as a lady's full skirt, long fingernails, and low light conditions. The buckle hook attached to the shoe can rotate freely and it is difficult to hold it upright with the fingers so that the strap buckle can be inserted properly when donning the shoe. When unfastening the buckle, there is still tension on the strap, and the buckle outer hook has a tendency to snag the strap and prevent release.

The solution to these problems is the shoe buckle tool of the present invention in the form of a loop of stiff wire attached to a handle. When donning, it is quick and simple to secure the buckle outer hook with the tool wire loop and lift/stabilize the hooked, shoe side, buckle. This allows the strap buckle to be easily inserted into the hooked buckle, then the tool is slipped off the outer hook. When unfastening the strap, the tool is used to lift the outer hook while pulling the strap buckle down and away from the outer hook, then the strap buckle is easily extracted from the shoe buckle and the tool is removed from the outer hook.

As an additional aid to using the tool properly, a small battery operated light is provided, oriented to shine on the area of the buckling operation. The preferred embodiment is a red light, with less impact on night-adapted vision, but it could also be a normal white light or even some other color.

Possible variations on the present invention are as follows:

1) General form
a) Handle/Hook with light
b) Handle/Hook only
2) Structure of Hook
a) Closed (as shown)
b) Open
3) Type of Illumination
a) Source
I) Light Emitting Diode
(preferred) ii) Incandescent Bulb
b) Placement
I) Protruding
ii) Recessed
c) Diffusing Lens
I) Present or
absent ii) Color
4) Electrical Potential a) Type of Battery
I) Replaceable Battery cells
ii) Rechargeable Battery cells
iii) Use-until-exhausted battery (throw-away)
iv) Number of cells (total voltage)
b) Electrical System (Switch required in all cases)
I) Batteries only (incandescent bulb) ii) Batteries and Resistor (with red LED) iii) Battery with Voltage-Boosting Circuit (required with white LED to keep number of battery cells practical)
5) Switch
a) Location
I) On top face near hook ii) On back end
iii) Other location
b) Type
I) Pushbutton
ii) Slide, etc.
6) Handle
a) Rectangular
b) Cylindrical
c) Color As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those, illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ballroom dance shoe aid comprising a ballroom dance shoe having a side section with a forwardly extending buckle hook, the buckle hook having a rearward region pivotably coupled to the side section, the buckle hook having a forward region in a generally u shaped configuration, the forward section having a central opening with an outer hook extending rearwardly to provide a passageway to and from the central opening; and a tool to facilitate donning the ballroom dance shoe, the tool having a lower component formed as a tool hook and an upper component formed as a handle, the handle having a configuration with a top, a bottom, a front, a back and sides, the handle having a chamber with a panel to provide access to the chamber, the tool hook extending downwardly from the bottom of the handle, the tool hook being fabricated of a rigid wire with parallel side portions and a semi-circular portion coupling the side portions, the side portions being parallel and laterally spaced by a fixed distance between the semi-circular portion and a location adjacent to the handle, the side portions being spaced by a width, the semi-circular portion being spaced from the bottom by a length, the width being less than half the length, an electrical assembly constituting a portion of the handle, the electrical assembly including a source of illumination, a source of potential being two batteries spaced within the handle, and a switch extending through the top of the handle.

2. A ballroom dance shoe aid for buckling and unbuckling a ballroom dance shoe, the aid comprising, in combination: with a the ballroom dance shoe having a side section with a forwardly extending buckle hook, the buckle hook having a rearward region pivotably coupled to the side section, the buckle hook having a forward region in a generally U-shaped configuration, the forward section having a central opening with an outer hook extending rearwardly to provide a passageway to and from the central opening, the aid being usable with the ballroom dance shoe; a strap having a rearward exterior section and a forward interior section and a strap buckle, the forward interior section being attached to the shoe, the strap buckle being fixedly secured to the strap between the rearward exterior section and the forward interior section, the strap forwardly of the strap buckle movable through the passageway when buckling and unbuckling the ballroom dance shoe; and a tool including a lower component formed as a tool hook and an upper component formed as a handle, the handle having a rectilinear configuration with a top, a bottom, a front, a back, and left and right sides, a chamber formed within the handle with a removable panel in the back to provide access to the chamber, the tool hook extending downwardly from the bottom of the handle, the tool hook being fabricated of a rigid wire with parallel side portions and a semi-circular portion coupling the side portions, the side portions being parallel and laterally spaced by a fixed distance between the semi-circular portion and a location adjacent to the handle, the side portions being spaced by a width, the semi-circular portion being spaced from the bottom by a length, the width being 18 to 25 percent of the length; and an electrical assembly constituting a portion of the handle, the electrical assembly including a source of illumination, a source of potential, a switch, and a resister, the source of illumination being a light emitting diode extending downwardly from the bottom of the housing and wherein the switch extends through the front adjacent to the bottom of the housing, and wherein the source of potential is two batteries laterally spaced within the housing.

* * * * *